US006258309B1

(12) United States Patent
Jo et al.

(10) Patent No.: US 6,258,309 B1
(45) Date of Patent: Jul. 10, 2001

(54) METHOD FOR THE PREPARATION OF POLYESTER FIBERS OF EXCELLENT WATER ABSORBENCY

(75) Inventors: Deog Jae Jo; Yeon Soo Kim, both of Kyongsangbuk-Do (KR)

(73) Assignee: Saehan Industries Incorporation, Kyongsangbuk-Do (KR)

( * ) Notice: Subject to any disclaimer, the term of this patent is extended or adjusted under 35 U.S.C. 154(b) by 0 days.

(21) Appl. No.: 09/440,073

(22) Filed: Nov. 15, 1999

(51) Int. Cl.[7] ..... D01F 1/10; D01F 6/62

(52) U.S. Cl. ..... 264/211

(58) Field of Search ..... 264/211

(56) References Cited

U.S. PATENT DOCUMENTS 5,939,341 * 8/1999 Brown et al. ..... 442/351

* cited by examiner

*Primary Examiner*—Leo B. Tentoni
(74) *Attorney, Agent, or Firm*—Harrison & Egbert

(57) ABSTRACT

A method for preparing polyester fibers whose water absorbency is comparable to that of natural fibers in which, at a suitable addition time from polyester polymerization to a stage prior to spinning; hydrophilic inorganic particles such as calcium oxide particles, magnesium oxide particles, and manganese oxide particles are added at an amount of 0.01–50 weight % based on the total weight of the fibers. This method enables polyester fibers to have superior water absorbency as well as excellent physical properties. As the inorganic particles are low-priced, this helps to keep down the total cost of producing the fibers.

5 Claims, No Drawings

METHOD FOR THE PREPARATION OF POLYESTER FIBERS OF EXCELLENT WATER ABSORBENCY

BACKGROUND OF THE INVENTION

1. Field of the Invention

The present invention relates to a method for preparing polyester fibers which are superior in water absorbency when compared to those of cotton and wool.

2. Description of the Prior Art

Polyester fibers are usually prepared mainly from terephthalic acid or aromatic dicarboxylic acid, such as 2,6-naphthalenedicarboxylic acid, or their ester derivatives, and ethylene glycol through polycondensation.

Polyester fibers are superior in mechanical properties and thermal resistance, but poor in water absorbency, when compared to natural fibers, such as regenerated cellulose, because polyester fibers have a structure of high crystallinity and few water-affinitive groups, e.g., hydrophilic groups in their molecules. The term "water absorbency" as used herein means the extent to which fiber mass, such as filaments, strands, textile fabrics, knitted goods, non-woven fabrics and the like, absorbs water. Where water absorbency is needed, the use of polyester fibers may cause a problem.

For this reason, active research has been directed to the development of polyester fibers which are of excellent water absorbency while retaining their physical properties.

For example, U.S. Pat. No. 3,329,557 and U.K. Pat. No. 956,833 disclose that polyester can be blended with hydrophilic polyalkylene glycol before spinning. The polyester fibers thus obtained, however, show fairly deteriorated physical properties in addition to not reaching a satisfactory level of water absorbency.

Korean Pat. Publication No. 93-6779 discloses a polyester with an organic compound having polyalkylene or polyamine as a main chain. Disclosed in Korean Pat. Publication No. 86-397 is a polyester mixed with the eluting agent $ROSO_3M$ (wherein R is an alkyl group containing 1–30 carbon atoms or an alkylaryl group containing 7–40 carbon atoms and M is an alkaline metal or an alkali earth metal) and spun and the fibers are made porous by elution treatment with an aqueous alkaline solution. These polyester fibers are significantly improved in water absorbency, but suffer from a significant disadvantage of being expensive. The additives are highly priced and additional processes increased the high production cost.

It is also known that polyester fibers are provided with hydrophilicity by addition with colloidal silica particles. This causes likewise an increase in production cost.

It is also known that polyester fibers are provided with hydrophilicity by addition with colloidal silica particles. This causes likewise an increase in production cost.

SUMMARY OF THE INVENTION

Therefore, it is an object of the present invention to overcome the above problems encountered in the prior art and to provide a method for preparing polyester fibers which show excellent water absorbency as well as physical properties.

It is another object of the present invention to provide a method for preparing polyester fibers, which does not significantly increase the production cost.

In one embodiment of the present invention, there is a method for preparing polyester fibers of excellent water absorbency, in which inorganic particles are added at an amount of 0.01–50 weight %, based on the total weight of the fibers, at a suitable addition time from polyester polymerization to a stage before spinning. In one aspect, the addition time is selected from a polyester polymerization stage, a stage in which polyester is flowed under pressure to a spinneret, and a stage in which polyester is melt-extruded to chips. In another aspect of the embodiment, the inorganic particles are selected from the group consisting of calcium oxide particles, magnesium oxide particles, manganese oxide particles and mixtures thereof and range in size from 0.01 to 50 $\mu$m.

DETAILED DESCRIPTION OF THE INVENTION

Polyester is usually prepared from polycarboxylic acid and polyhydric alcohol. For the polyester fibers of the present invention, aromatic dicarboxylic acid or its ester derivatives are employed. Examples of the aromatic dicarboxylic acid useful in the present invention include isophthalic acid, terephthalic acid, 2,6-naphthalenedicarboxylic acid, phthalic acid, adipic acid, sebacic acid, and mixtures thereof. As the polyhydric alcohol, ethylene glycol is mainly used, together with a small amount of other alcohols, such as propylene glycol, butanediol, 1,4-cyclohexanediol and neopentylglycol.

If necessary, additives such as thermal stabilizers, antiblocking agents, antioxidants, antistatic agents, UV absorbents, etc, may be used in preparing polyester fibers.

In accordance with the present invention, inorganic particles are used in preparing polyester fibers, in order to endow the polyester fibers with high hydrophilicity. The inorganic particles are selected from the group consisting of calcium oxide particles, magnesium oxide particles, manganese oxide particles, and mixtures thereof.

As for the addition time of the inorganic particles during the preparation of polyester fibers, it may be selected from a polyester polymerization stage, a stage in which polyester is flowed under pressure to a spinneret, and a stage in which polyester is melt-extruded to chips.

In the polyester polymerization stage, the inorganic particles are preferably added at the time just after completion of the esterification step, or at the time of the polycondensation step. In this regard, the inorganic particles to be added must not contain moisture lest the reaction is inhibited.

After being polymerized through polycondensation, polyester is transferred under pressure to a spinneret in order to spin polyester fibers. In the course of this transfer, calcium oxide particles, magnesium oxide particles, manganese oxide particles or mixtures thereof may be added. In this connection, some of the polymer is drawn from the transfer pipe, added with the inorganic particles, and returned to the remaining polymer in the pipe.

When the polyester polymerized is transferred to an extruder to produce polyester chips, the inorganic particles are fed directly. The inorganic particle-containing polyester chips can be used in the present invention, alone or in combination with other polyester chips.

Typically, calcium oxide particles can be obtained from calcium carbonate ores. First, calcium carbonate ores are pulverized to small pieces and baked at about 1,000° C. in a furnace to separate calcium oxide and carbon oxide. Calcium carbonate particles are advantageous in that they are easily obtained and low-priced owing to simple manufacturing processes. When encountered with water, calcium oxide is readily converted into calcium hydroxide ($Ca(OH)_2$). Accordingly, this high hydrophilicity of calcium oxide enables the polyester fibers to have excellent water absorbency. This mechanism of improving water absorbency is true of magnesium oxide and manganese oxide.

Preferably, the inorganic particles range, in size, from 0.01 to 50 $\mu$m. For example, when inorganic particles with a size less than 0.01 μm are used, a great improvement is not brought about in the water absorbency. On the other hand, inorganic particles greater than 50 μm readily cause fiber cutting upon spinning processes or after-treatment processes. The inorganic particles are preferably used at an amount of about 0.1–50 weight %, based on the weight of the polyester. For example, the amount smaller than 0.1 weight % gives a trace contribution to the improvement in water absorbency while the amount greater than 50 weight % deleteriously affects the physical properties of the polyester.

As mentioned above, the inorganic particles must not contain water nor impurities, otherwise, deterioration is found in the spinnability and after-treatment process. Further, because the presence of inorganic particles in polyester is a direct factor to abrade the physical properties of the polyester, it is preferred that the inorganic particles be as pure as possible.

A better understanding of the present invention may be obtained in light of the following examples which are set forth, but are not to be construed to limit the present invention.

EXAMPLE I 100 weight parts of terephthalic acid and 45 weight parts of ethylene glycol were placed in reactor, which then were esterified for 4 hours by heating to 140–230° C. with stirring. After being adding 0.04 weight parts of antimontrioxide and 0.015 weight parts of phosphoric acid per weight part of ethylene glycol, the esterified mixture was subjected to polycondensation at 230–285° C. for 4 hours under vacuum to give polyester I.

The polyester I was solidified with liquid nitrogen and pulverized to a powder. Thereafter, 80 weight parts of the powder were homogeneously mixed for 30 min with 20 weight parts of calcium oxide particles ranging in size, from 0.01 to 50 μm with an average size of 0.4 μm, followed by allowing the homogeneous mixture to go through a twin-screw melt-extruder which was being operated at 240–290° C. under vacuum, to give polyester II.

90 weight parts of the polyester I and 10 weight parts of the polyester II were mixed, dried at 160° C. for 6 hours with hot air, melted through a melt extruder which was being operated at 290° C., and spun through a spinneret, to give 75/24 polyester fibers.

EXAMPLE II

75/24 polyester fibers were prepared in a similar manner to that of Example I, except that 95 weight parts of the polyester I and 5 weight part of the polyester II were used.

COMPARATIVE EXAMPLE I 100 weight parts of terephthalic acid and 45 weight parts of ethylene glycol were placed in a reactor, which then were esterified for 4 hours by heating to 140–230° C. with stirring. After adding 0.04 weight parts of antimontrioxide and 0.015 weight parts of phosphoric acid per weight part of ethylene glycol, the esterified mixture was subjected to polycondensation at 230–285° C. for 4 hours under vacuum to give polyester I.

The polyester I was solidified with liquid nitrogen and pulverized to powder. Thereafter, 80 weight parts of the powder were homogeneously mixed for 30 min with 20 weight parts of colloidal silica particles with an average size of 0.3 μm, followed by allowing the homogeneous mixture to go through a twin-screw melt-extruder which was being operated at 240–290° C. under vacuum, to give polyester III.

90 weight parts of the polyester I and 10 weight parts of the polyester III were mixed, dried at 160° C. for 6 hours with hot air, melted through a melt-extruder which was being operated at 290° C., and spun through a spinneret, to give 75/24 polyester fibers.

COMPARATIVE EXAMPLE II

75/24 polyester fibers were prepared in a similar manner to that of Comparative Example I, except that 95 weight parts of the polyester I and 5 weight parts of the polyester III were used.

The polyesters obtained in Examples and Comparative Examples were measured for physical properties and the results are given in Table 1, below.

TABLE 1

| | Examples | | | |
|---|---|---|---|---|
| Physical Properties | I | II | C.I | C.II |
| Denier | 75/24 | 75/24 | 75/24 | 75/24 |
| Strength (g/denier) | 4.78 | 4.78 | 4.79 | 4.79 |
| Elongation (%) | 38.64 | 38.32 | 38.90 | 38.91 |
| Water-Absorbency (wt %) | 8.2 | 4.3 | 1.4 | 1.2 |

As apparent from the data of Table 1, the method according to the present invention provides polyester fibers with superior water absorbency and similar physical properties as fibers of the conventional method. In addition, the present invention has an advantage over conventional methods in that the production cost is significantly lowered due to the low-priced inorganic particles.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method of preparing polyester fibers of excellent water absorbency, the method comprising:

polymerizing a polyester by polycondensing a polycarboxylic acid selected from the group consisting of terephthalic acid and aromatic dicarboxylic acid;

spinning of the polyester into polyester fibers; and adding inorganic particles to the polyester during of after the step of polymerizing and prior to said step of spinning, said inorganic particles added to an amount of 0.01 to 50 weight percent based on the total weight of the polyester fibers.

2. The method of claim 1, said step of adding inorganic particles being during said step of polymerizing.

3. The method of claim 1, further comprising:

flowing the polyester under pressure to a spinneret prior to said step of spinning, said step of adding inorganic particles being during the step of flowing the polyester.

4. The method of claim 1, further comprising:

melt extruding the polyester into chips prior to said step of spinning, said step of adding inorganic products being during the step of melt extruding the polyester.

5. The method of claim 1, wherein the inorganic particles are selected from the group consisting of calcium oxide particles, magnesium oxide particles, manganese oxide particles, and mixtures thereof, said inorganic particles having a size of between 0.01 and 50 micrometers.

* * * * *